US007258048B2

(12) United States Patent
Rastegar et al.

(10) Patent No.: US 7,258,048 B2
(45) Date of Patent: Aug. 21, 2007

(54) MANUALLY OPERATED IMPACT WRENCH

(75) Inventors: Jahangir S. Rastegar, Stony Brook, NY (US); Thomas Spinelli, East Northport, NY (US)

(73) Assignee: Omnitek Partners L.L.C., Bayshore, NY (US)

( * ) Notice: Subject to any disclaimer, the term of this patent is extended or adjusted under 35 U.S.C. 154(b) by 0 days.

(21) Appl. No.: 11/395,494

(22) Filed: Mar. 31, 2006

(65) Prior Publication Data

US 2006/0237204 A1 Oct. 26, 2006

Related U.S. Application Data

(60) Provisional application No. 60/671,653, filed on Apr. 16, 2005.

(51) Int. Cl.
*B25B 19/00* (2006.01)
*B25D 15/00* (2006.01)
*B25B 33/00* (2006.01)

(52) U.S. Cl. ..... 81/466; 173/93.5

(58) Field of Classification Search ..... 81/463, 81/466; 173/93.5

See application file for complete search history.

(56) References Cited

U.S. PATENT DOCUMENTS 2,661,647 A * 12/1953 Swenson ..... 173/93.5
2,844,982 A * 7/1958 Swenson ..... 173/20
2,954,714 A * 10/1960 Swenson ..... 173/93.5
3,108,506 A * 10/1963 Swenson ..... 173/93.5
3,156,309 A 11/1964 Swenson
3,157,074 A * 11/1964 Durkee ..... 173/93
3,184,998 A * 5/1965 Young ..... 173/93.5
4,106,572 A 8/1978 Anderson
4,184,552 A * 1/1980 Anderson ..... 173/93.5
4,243,109 A 1/1981 Anderson
4,293,044 A 10/1981 Anderson
4,382,476 A * 5/1983 Swenson ..... 173/93.5
4,418,768 A * 12/1983 Swenson ..... 173/93.5
4,455,899 A * 6/1984 Savell ..... 81/466
4,474,091 A 10/1984 Russ
4,708,209 A * 11/1987 Aspinwall ..... 173/93
4,759,242 A * 7/1988 Andersson ..... 81/466
4,794,830 A 1/1989 Gross et al.
5,095,784 A * 3/1992 Garver ..... 81/466
6,679,143 B2 * 1/2004 Rastegar et al. ..... 81/466
6,997,087 B2 * 2/2006 Rastegar et al. ..... 81/466
2004/0055431 A1 * 3/2004 Rastegar et al. ..... 81/466
2006/0090614 A1 * 5/2006 Rastegar et al. ..... 81/466

* cited by examiner

*Primary Examiner*—David B. Thomas

(57) ABSTRACT

A manually operated impact tool is provided and includes: an impact mass; an anvil rotatably disposed relative to the impact mass; an input member operatively connected to one of the impact mass and anvil mass for imparting a relative rotation between the impact mass and the anvil; an output member connected to the other of the impact mass and anvil mass for transferring an impact to a fastener; and one or more elastic elements for storing potential energy upon the relative rotation between the impact mass and the anvil. Wherein conversion of the potential energy to kinetic energy causes the impact mass to impact the anvil and transfer of the impact to the output member.

20 Claims, 8 Drawing Sheets

MANUALLY OPERATED IMPACT WRENCH

CROSS-REFERENCE TO RELATED APPLICATIONS

This application claims the benefit of U.S. Provisional Application Ser. No. 60/671,653, filed Apr. 16, 2005, the entire contents of which is incorporated herein by its reference. The manually operated impact wrenches described herein are similar to those described in U.S. Pat. Nos. 6,679,143 and 6,997,087 and U.S. application Ser. No. 11/333,852, the disclosures of which are also incorporated herein by reference.

BACKGROUND OF THE INVENTION

1. Field of the Invention

The present invention relates generally to impact tools and, more particularly, to a manually operated impact tool for loosening or tightening a fastener, such as a lug nut.

2. Prior Art

Impact based or impact assisted wrenches of the prior art operate using electric, pneumatic and in some cases hydraulic power to loosen and/or tighten fasteners such as nuts threaded on a mating treaded stud. The impact force generated by such wrenches greatly assists the loosening and tightening operation of such devices by generating a large impulsive force at the fastener interface. As the result, and in many cases due also to the generated stress waves that travels across the male and female fastener surfaces, such wrenches are operated with a significantly smaller operator effort. In certain situations, the large forces and/or moment and/or torque that has to be applied to a manually operated wrench to begin to open the fastener may cause its failure, particularly since such forces cannot usually be applied perfectly symmetrically, i.e., only in the direction that would open the fastener without unwanted added forces. For example, an operator applying a torque to a manually operated socket wrench to open a bolt may also apply a large shearing force and/or bending moment while exerting his maximum effort to open the fastener and thereby may cause the bolt to shear off during the procedure. Such failures seldom occur while using impact based wrenches since the operator does not have to exert his or her maximum effort in the above manner to operate the wrench.

It can safely be claimed that the relative ease with which impact based wrenches are operated to loosen or tighten various fasteners is well appreciated by their users. However, such wrenches require electric, pneumatic or some other type of generally electric based power in order to operate. In addition, such systems are generally heavy, bulky and expensive to be carried by the operator to all sites. This is particularly the case for the infrequent user such as a driver who may require the wrench in case of a flat tire to loosen and fasten the tire bolts or nuts.

A need therefore exists in the art for manually operated impact wrenches that are simple to use, light weight and inexpensive, particularly for the casual user and professional user who does not have access to a power source at the work site or who does not want to carry a heavy load to a site or may seldom face the need for its use.

SUMMARY OF THE INVENTION

Accordingly, a manually operated impact tool is provided. The manually operated impact tool comprising: an impact mass; an anvil rotatably disposed relative to the impact mass; an input member operatively connected to one of the impact mass and anvil mass for imparting a relative rotation between the impact mass and the anvil; an output member connected to the other of the impact mass and anvil mass for transferring an impact to a fastener; and one or more elastic elements for storing potential energy upon the relative rotation between the impact mass and the anvil; wherein conversion of the potential energy to kinetic energy causes the impact mass to impact the anvil and transfer of the impact to the output member.

The impact mass can comprise two impact masses and the anvil comprises two anvils disposed on an anvil member, each of the impact masses extending in opposite directions from an impact member and configured to impact one of the two anvils. The anvil member and impact member can rotate relative to each other about a central portion. Each of the anvil member and impact member can further have a reduced thickness portion at the central portion such that when assembled together, an overall thickness of the assembled anvil member and impact member is less than the combined thickness of the impact member and anvil member outside of the central portion.

The input member can comprise a frame rotatably disposed relative to one of the anvil and impact mass, the frame can have a portion which interferes with one of the anvil and impact mass such that rotation of the frame causes a rotation of the one of the anvil and impact mass relative to the other of the anvil and impact mass. The frame can further have a nut for facilitating rotation thereof. The one or more elastic elements can be attached between the frame and the one of the anvil and impact mass to bias the one of the anvil and impact mass towards the other of the anvil and impact mass. The one or more elastic elements can comprise two pairs of springs, each pair being disposed symmetrically around the one of the anvil and impact mass.

The output member can be an output shaft connected to the one of the anvil and impact mass. The output shaft can have a male socket at an end thereof.

The manually operated impact tool can further comprise: an engagement member disposed on one of the anvil and impact mass for engaging the other of the anvil and impact mass and maintaining the anvil and impact mass in a predetermined position relative to each other; and a release member disposed on one of the other of the anvil and impact mass and the input member for releasing the engagement and causing the conversion of the potential energy to kinetic energy.

Also provided is a manually operated impact tool comprising: an impact member having a pair of impact masses; an anvil member having a pair of anvil members, the anvil member being rotatably disposed relative to the impact member such that each of the impact masses corresponds to each of the anvils; an input member operatively connected to one of the impact member and anvil member for imparting a relative rotation between the impact member and the anvil member; an output member connected to the other of the impact member and anvil member for transferring an impact to a fastener; and one or more elastic elements for storing potential energy upon the relative rotation between the impact member and the anvil member; wherein conversion of the potential energy to kinetic energy causes each of the impact masses to impact a corresponding anvil and transfer of the impact to the output member. Each of the pair of impact masses can extend in opposite directions from the impact member. The anvil member and impact member can rotate relative to each other about a central portion. Each of the anvil member and impact member can further have a reduced thickness portion at the central portion such that when assembled together, an overall thickness of the assembled anvil member and impact member is less than the combined thickness of the impact member and anvil member outside of the central portion.

The input member can comprise a frame rotatably disposed relative to one of the anvil member and impact member, the frame can have a portion which interferes with one of the anvil member and impact member such that rotation of the frame causes a rotation of the one of the anvil member and impact member relative to the other of the anvil member and impact member. The frame can further have a nut for facilitating rotation thereof. The one or more elastic elements can be attached between the frame and the one of the anvil member and impact member to bias the one of the anvil member and impact member towards the other of the anvil member and impact member. The one or more elastic elements can comprise two pairs of springs, each pair being disposed symmetrically around the one of the anvil member and impact member.

The output member can be an output shaft connected to the one of the anvil member and impact member. The output shaft can have a male socket at an end thereof.

The manually operated impact tool can further comprise: an engagement member disposed on one of the anvil member and impact member for engaging the other of the anvil member and impact member and maintaining the anvil member and impact member in a predetermined position relative to each other; and a release member disposed on one of the other of the anvil member and impact member and the input member for releasing the engagement and causing the conversion of the potential energy to kinetic energy.

Still further provided is a method for manually imparting an impact, the method comprising: rotatably disposing an impact mass relative to an anvil; rotating an input member in a first direction to impart a relative distance between the impact mass and the anvil; storing potential energy upon the rotation in the first direction of the input member; and rotating the input member in a second direction to convert the potential energy to kinetic energy causing the impact mass to impact the anvil and transfer of the impact to an output member.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENT

Although the present invention is applicable to numerous types of impact tools, it is particularly useful in the environment of impact wrenches for removing lug nuts from automobile wheels. Therefore, without limiting the applicability of the present invention to impact wrenches for removing lug nuts from automobile wheels, it will be described in such environment.

Figure 1:
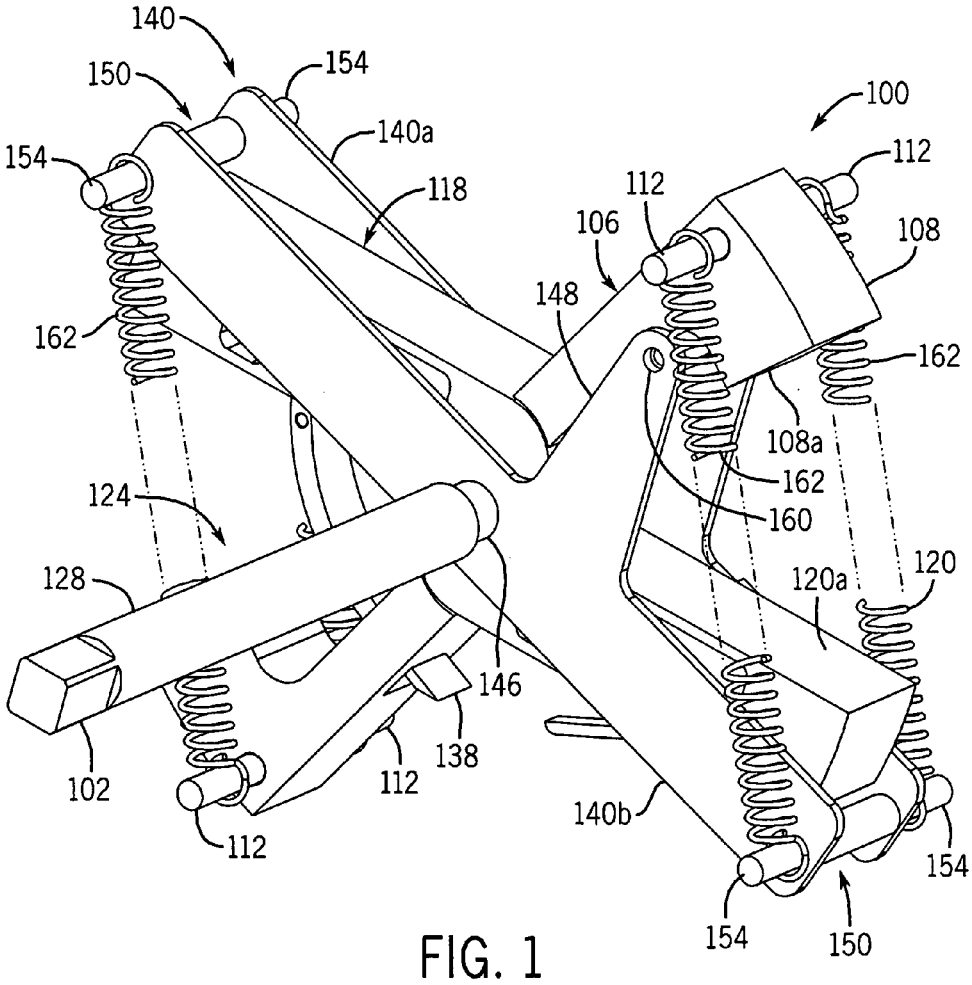
FIG. 1 illustrates a perspective view of an output side of an impact tool which is in an open or loaded position.
Figure 2:
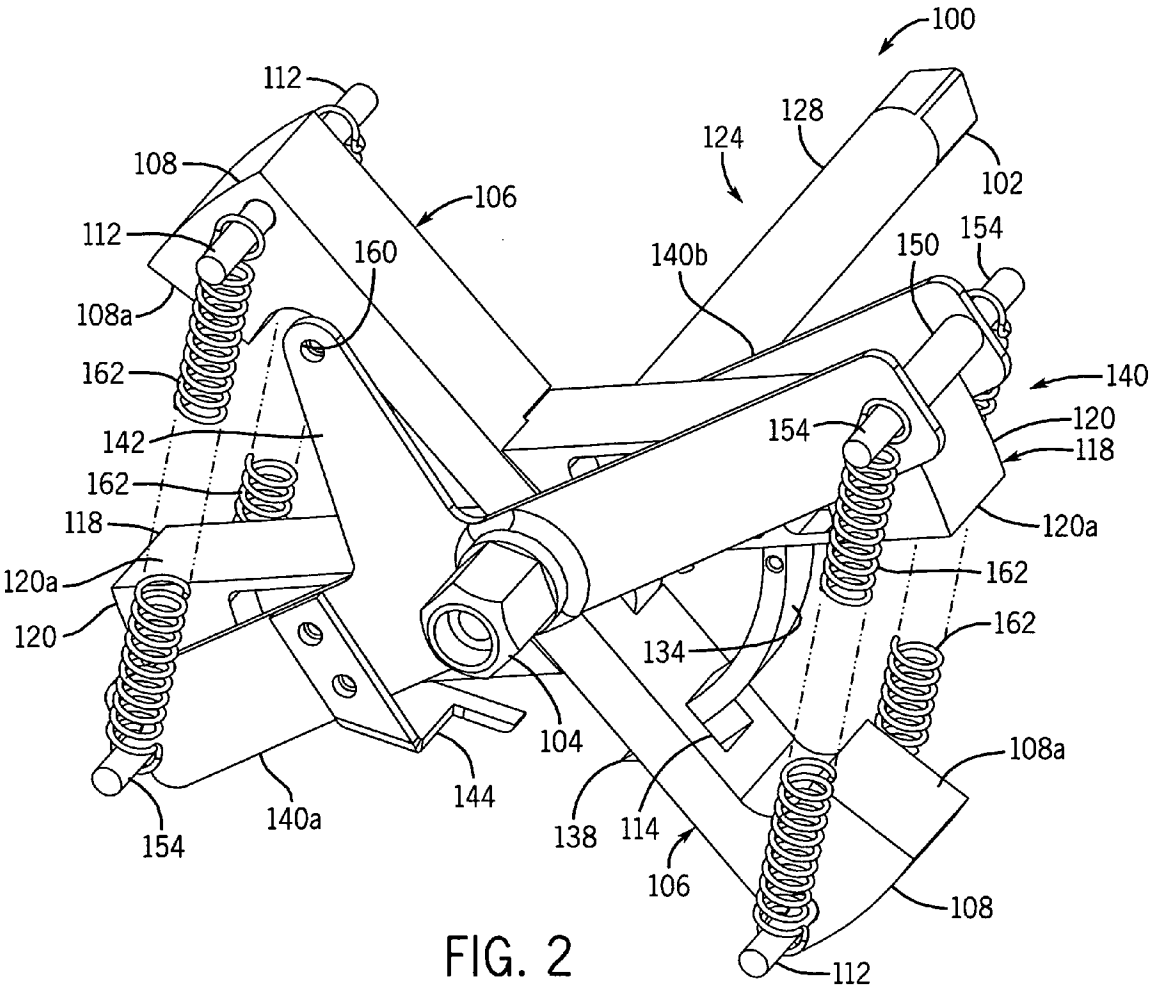
FIG. 2 illustrates a perspective view of an input side of the impact tool.

Referring now to FIGS. 1 and 2, there is illustrated an impact tool in the form of an impact wrench, generally referred to by reference numeral 100. The impact wrench 100 has an output side shown in FIG. 1 with a male socket part 102 for holding a socket (not shown) which is in turn disposed on a nut, such as a lug nut. Alternatively, the output side can have a particular size socket permanently mounted thereon. Furthermore, the output side can have a different type of tool either permanently or removable mounted thereon, such as a plain or Philips type screwdriver head or an allen key. The impact wrench 100 further has an input side shown in FIG. 2 with a hexagonal nut 104. The impact wrench 104 is operated, as discussed below, by rotating the hexagonal nut 104 a predetermined amount of rotation. The hexagonal nut is rotated by disposing a tool over the same and rotating the tool (not shown). For example, a lug wrench (not shown) can be used to turn the hexagonal nut 104 or other tool, such as an adjustable wrench, open or closed end wrench, or a socket wrench. Other shaped nuts or configurations can also be used at the input side. Furthermore, a handle can be permanently or releasably mounted at the input side. Although shown open, the impact wrench 100 can be covered, wholly or partially by a cowl (not shown). However, the hexagonal nut 104 (or other means disclosed above) as well as the male socket 102 (or other means disclosed above) must be exposed from the cowl to permit operation on the impact wrench as well as operation on the fastener to be loosened. Lastly, although the impact wrench is described as loosening a fastener, those skilled in the art will appreciate that the same can be provided in a mirrored configuration to tighten a fastener.

Figure 3:
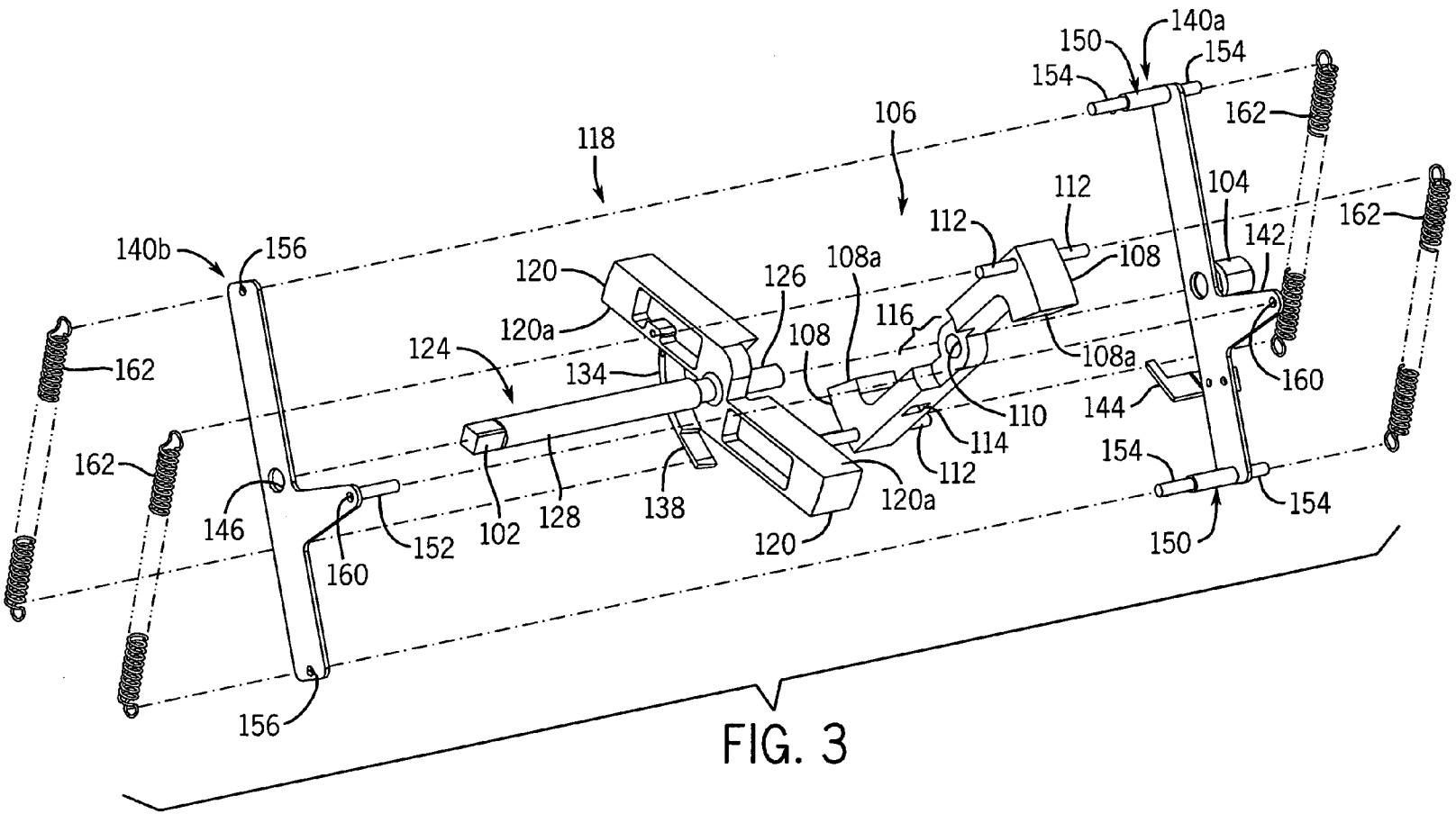
FIG. 3 illustrates an exploded view from the output side of the impact tool of FIG. 1.
Figure 4:
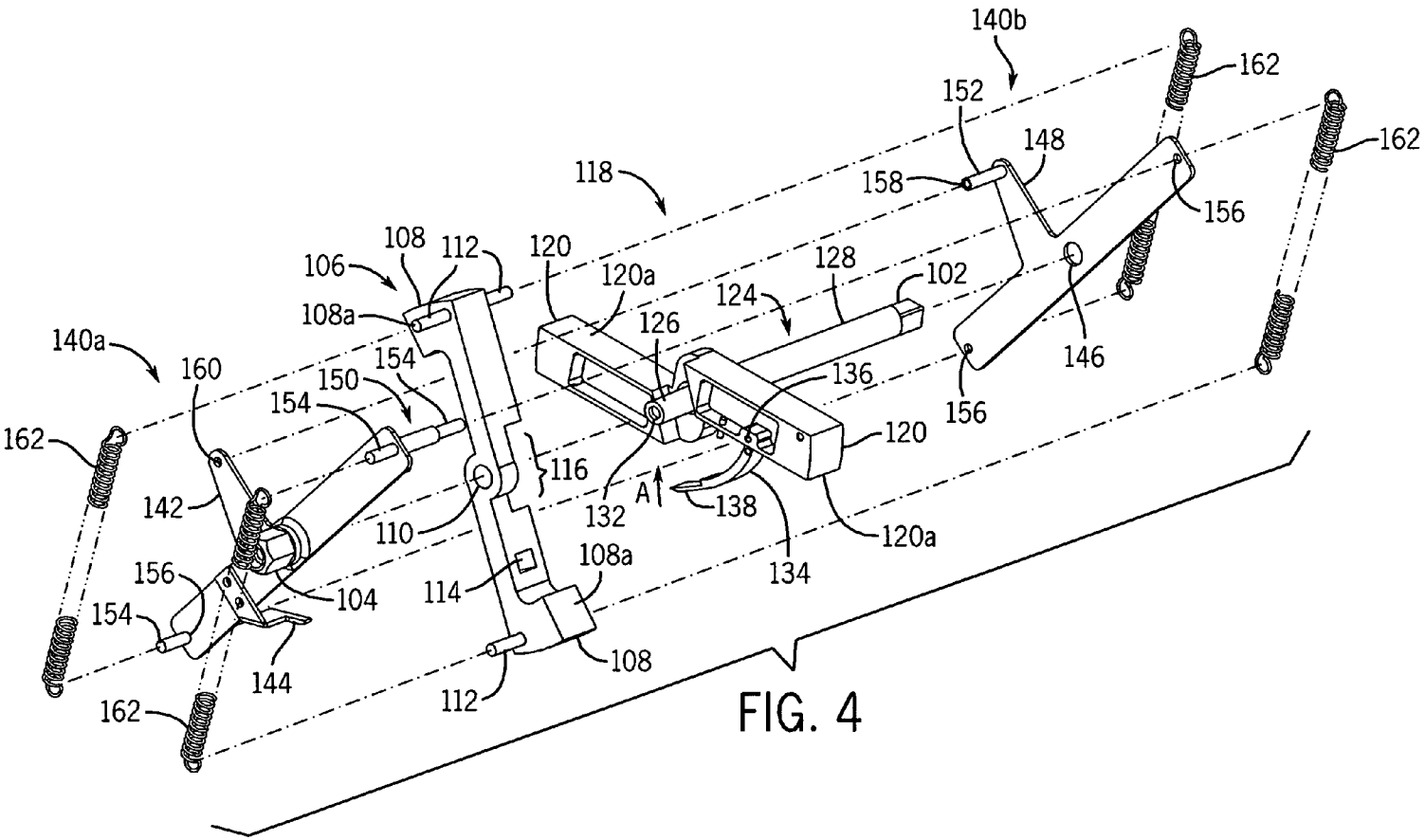
FIG. 4 illustrates an exploded view from the input side of the impact tool of FIG. 2.

Referring now also to FIGS. 3 and 4, the impact wrench 100 has an impact member 106 having impact masses 108 arranged at opposite ends of the impact member 106. The impact masses 108 extend from the impact member 106 in opposite directions culminating in an impact surface 108*a* and are equally distanced from a central bore 110. The impact member 106 further has spring posts 112 disposed at each end. The spring posts 112 can be pins that are fit into corresponding holes or threaded studs that are threaded into mating threaded holes. The impact member 106 further has an engagement widow 114 at one end disposed between the central bore 110 and one of the impact masses 108. The impact member 106 has a reduced thickness portion 116 at a central portion thereof. The impact member 108 can be fabricated from a durable material, such as machine steel.

Figure 5B:
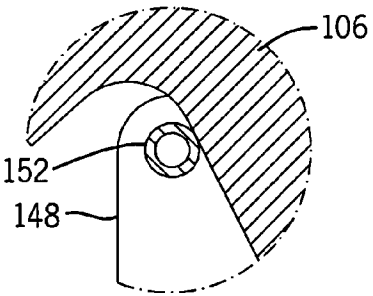
FIG. 5B illustrates an enlarged view of detail 5B of FIG. 5A.
Figure 5C:
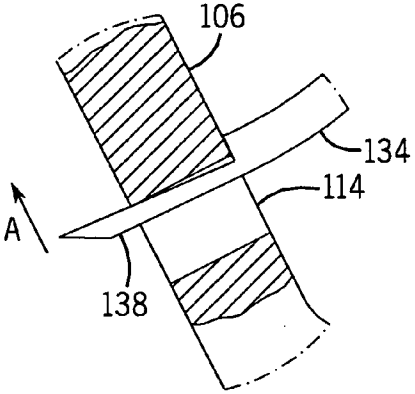
FIG. 5C illustrates an enlarged view of detail 5C of FIG. 5A.

The impact wrench 100 also has an anvil member 118 having first and second anvil members 120 disposed at ends thereof. The anvil member further has a central bore 122 in which is disposed an output shaft 124. The output shaft 124 can also be integral with the anvil member 118. The output shaft 124 has a first end 126 which is rotatably disposed in the central bore 110 of the impact member 106 and a second end 128 which has the male socket part 102 at an end thereof. The anvil member 118 further has a reduced thickness portion 130 corresponding to the reduced thickness portion 116 of the impact member 106 such that the impact member 106 and anvil member 118 mate together and rotate relative to each other within a predetermined angle range, as shown in FIGS. 1 and 2. When mated, anvil surfaces 128*a* of the anvil member 118 correspond to the impact surfaces 108*a* of the impact member 106. The first end 126 of the output shaft may be provided with a female thread 132 and a fastener (not shown) may be provided through the central bore 110 of the impact member 106 to retain the impact member 106 and anvil member 118 together. In this regard, the central bore 110 of the impact member 106 may have a counter bore (not shown) for acceptance of a head of the fastener so as not to interfere with other parts of the impact wrench 100. The anvil member 118 further has an engagement member 134 which is rotatably disposed on one end of the anvil member 118 by a pin 136 or the like. The rotation of the release member can be limited by stops such that it rotates only through a small angle and it biased in direction A by a spring or other biasing member (not shown). As shown clearly in FIGS. 5A and 5C, the engagement member 134 has a stepped portion 138 at a free end thereof that is disposed in the engagement window 114 of the impact member 106.

The impact wrench 100 further has an outer frame 140 including an input side frame 140*a* and an output side frame 140*b*. The input side frame 140*a* is rectangular in shape and has the hexagonal nut 104 fixed at a central position thereof, such as by welding or the like. The hexagonal nut 104, or any other input means can also be integral with the input side frame 140*a*. The input side frame 140*a* further has a projection 142. The input side frame 140*a* also has a release member 144 fixed thereto, such as by welding, screws or the like and may also be integrally formed with the input side frame 140*a*. The output side frame 140*a* is also rectangular shaped and has a central bore 146 in which the output shaft 124 is rotatably disposed. The output side frame 140*b* also has a projection 148 corresponding to the projection 142 of the input side frame 140*a*. The input side frame 140*a* and output side frame 140*b* are assembled around the impact member 106 and anvil member 118 with the output shaft 124 disposed in the central bore 146 of the output side frame 140*b* and separated by a predetermined distance by spring pins 150 and cam pin 152. The spring pins 148 have stepped portions 154 at each end thereof which are disposed in mating holes 156 in each end of the input side frame 140*a* and output side frame 140*b*. The portion between the stepped portions 154 maintains the input side frame 140*a* and output side frame apart by the predetermined distance such that the impact member 106 and anvil member 118 can rotate within the frame 140. Nuts (not shown) can be disposed on threaded portions of the stepped portions 154 to secure the input side frame 140*a* and output side frame 140*b* together. The cam pin 152 is secured between the projections 142, 148 of the input side frame 140*a* and output side frame 140*b*, respectively. The cam pin 152 can have female threads 158 at each end thereof and the same can be secured by screws (not shown) disposed through holes 160 on the projections 142, 148 which mate with the female threads 158.

Elastic members, such as springs 162 bias the impact member 106 towards the frame 140. The springs 162 (shown broken in the figures for clarity) attach at one end to the spring posts 112 of the impact member 106 and attach at the other end to the stepped portion 154 of the spring pins 150. The spring ends can be secured to the spring posts 112 and spring pins 150 by any means known in the art such as the spring posts 112 and spring pins 150 having small holes for acceptance of the spring ends. The impact wrench 100 shown in the Figures utilizes two pairs of springs 162, two at each end of the impact member 106. Other elastic members can also be used, such as rubber members.

Figure 5A:
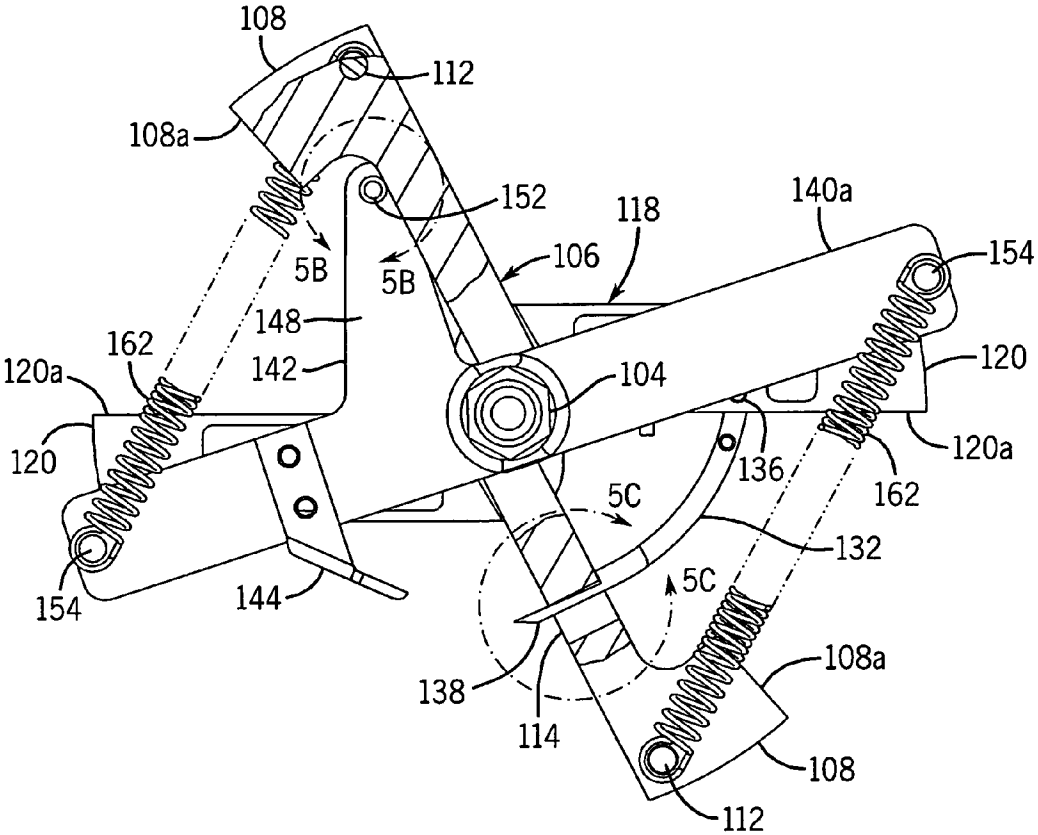
FIG. 5A illustrates a side view of the input side of the impact tool of FIG. 2 in which the impact tool is open and loaded for an impact.

The operation of the impact wrench 100 will now be explained with reference to FIGS. 5A-8. Referring first to FIG. 5A, the impact member 106 is rotated clockwise relative to the anvil member 118 by turning the hexagonal nut 104 (and frame 140 connected thereto) into the position shown in FIG. 5A (from a starting position shown in FIG. 8). Upon the clockwise rotation, the cam pin 152 urges against a surface 164 of the impact member 106 relative to the anvil member 118 as shown clearly in FIG. 5B. The impact member 106 rotates relative to the anvil member 118 until the stepped portion 138 of the engagement member 134 catches in the engagement window 114 of the anvil member, as shown clearly in FIG. 5C. At this point, the springs 162 will be stretched and the impact wrench is loaded for an impact. Also at this point, the position of the impact member 106 relative to the anvil member 118 is fixed by engagement of the stepped portion 138 of the engagement member 134 with the engagement window 114. As discussed above, the engagement member 134 is biased in the direction of Arrow A to maintain the engagement.

Figure 6B:
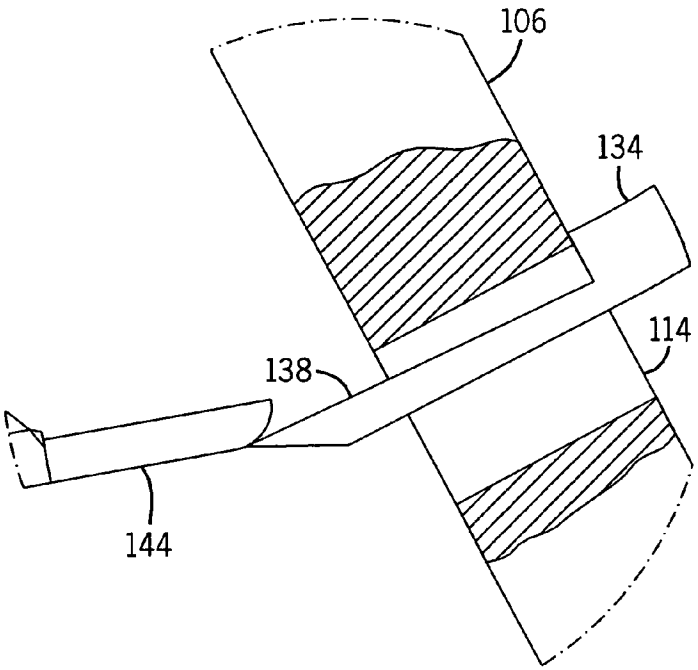
FIG. 6B illustrates an enlarged view of detail 6B of FIG. 6A.
Figure 6A:
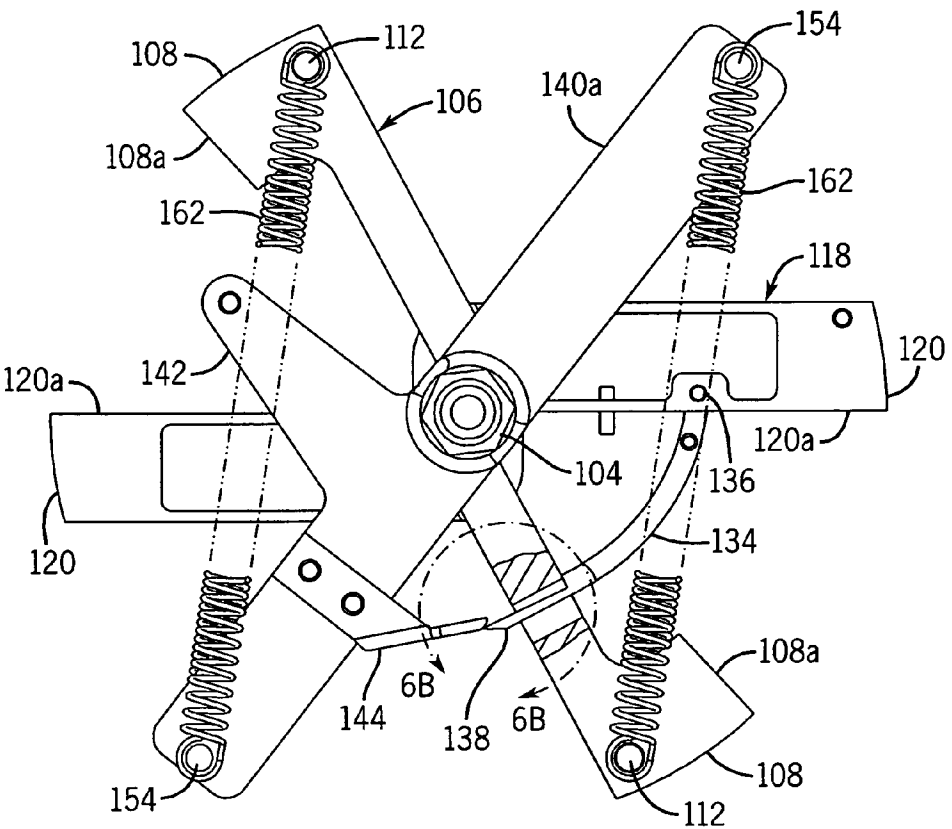
FIG. 6A illustrates a side view of the input side of the impact tool of FIG. 5A prior to the impact masses being released for impact.

Referring now to FIGS. 6A and 6B, the hexagonal nut 104 (and frame 140 attached thereto) is rotated counterclockwise until the release member 144 begins to engage the stepped portion 138 of the engagement member 134 in a direction opposite to Arrow A against the biasing of the engagement member 134. As can be seen clearly in FIG. 6B, the engagement of the release member 144 moves the stepped portion 138 from engagement with the engagement window 114.

Figure 7B:
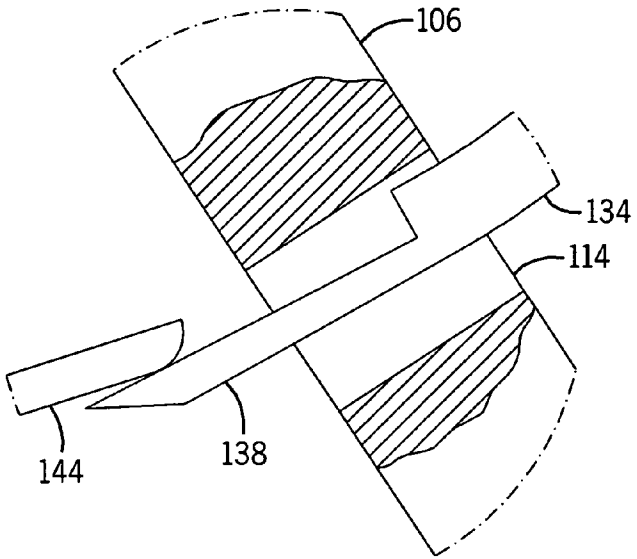
FIG. 7B illustrates an enlarged view of detail 7B of FIG. 7A.
Figure 7A:
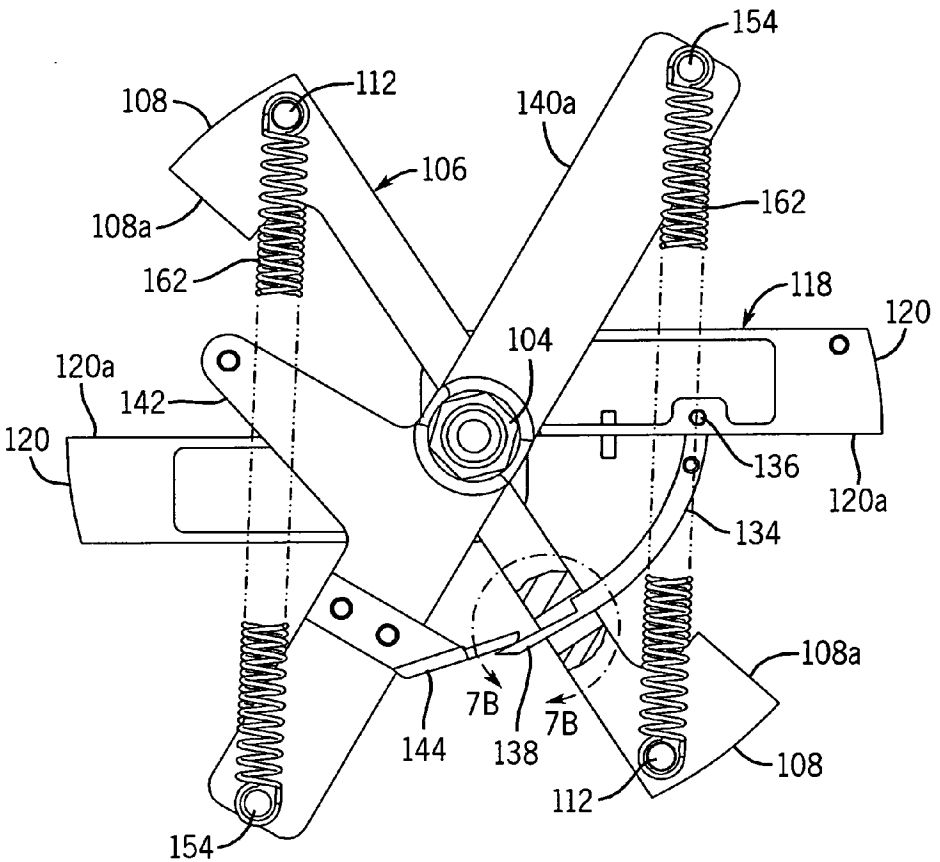
FIG. 7A illustrates a side view of the input side of the impact tool of FIG. 5A in which the impact masses are released for impact.
Figure 8:
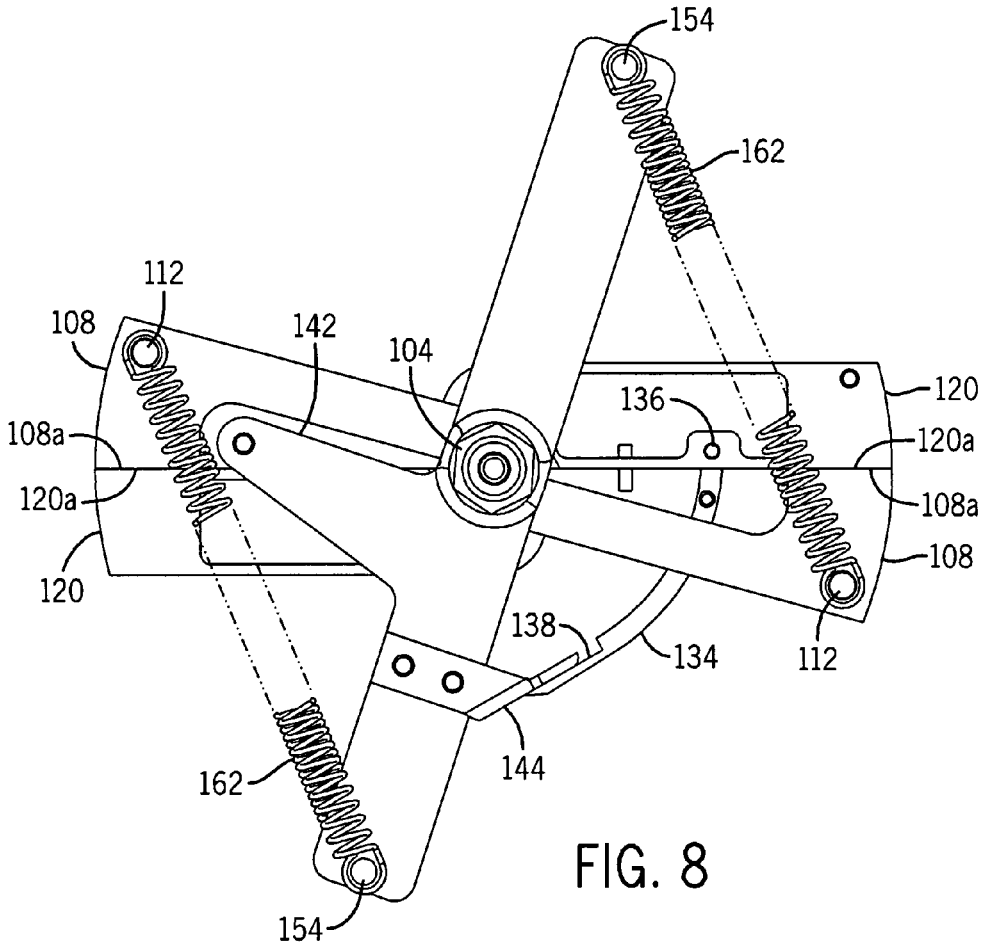
FIG. 8 illustrates a side view of the input side of the impact tool of FIG. 5A upon impact of the impact masses with corresponding anvil surfaces.

Referring now to FIGS. 7A and 7B, continued counterclockwise rotation of the hexagonal nut 104 (and frame 140 attached thereto) causes the stepped portion 138 of the engagement member 134 to completely disengage from the engagement window 114, as clearly shown in FIG. 7B. Therefore, the potential energy in the springs 162 will be converted to kinetic energy and accelerate the impact member 106 towards the anvil member 118. As shown in FIG. 8, the impact surfaces 108*a* of the impact masses 108 will impact the corresponding anvil surface 120*a* of the anvils 120. The impact is transferred through the impact member 118 to the male socket part 102 of the output shaft 124 which is attached to the anvil member 118. The output shaft 124 in turn transfers the impact to a fastener to be loosened (or tightened in a mirrored configuration). Since the impact masses 108 extend from the impact member 106 in opposite directions, their impacts each contribute to rotating the anvil member 118 and output shaft 124 connected thereto in the same direction.

The size and number of the impact masses and/or number and strength of the springs can be varied to scale the magnitude of the impact for the particular application. For example, a smaller impact can be used for use with hand tools to loosen stubborn nuts, while a larger impact can be used for use in removing lug nuts from automobiles and trucks.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A manually operated impact tool comprising:

an impact mass;

an anvil rotatably disposed relative to the impact mass;

an input member operatively connected to one of the impact mass and anvil mass for imparting a relative rotation between the impact mass and the anvil;

an output member connected to the other of the impact mass and anvil mass for transferring an impact to a fastener; and one or more elastic elements for storing potential energy upon the relative rotation between the impact mass and the anvil;

wherein conversion of the potential energy to kinetic energy causes the impact mass to impact the anvil and transfer of the impact to the output member and the input member comprises a frame rotatably disposed relative to one of the anvil and impact mass, the frame having a portion which interferes with one of the anvil and impact mass such that rotation of the frame causes a rotation of the one of the anvil and impact mass relative to the other of the anvil and impact mass.

2. The manually operated impact tool of claim 1, wherein the impact mass comprises two impact masses arid the anvil comprises two anvils disposed on an anvil member, each of the impact masses extending in opposite directions from an impact member and configured to impact one of the two anvils.

3. The manually operated impact tool of claim 2, wherein the anvil member and impact member rotate relative to each other about a central portion.

4. The manually operated impact tool of claim 3, wherein each of the anvil member and impact member further have a reduced thickness portion at the central portion such that when assembled together, an overall thickness of the assembled anvil member and impact member is less than the combined thickness of the impact member and anvil member outside of the central portion.

5. The manually operated impact tool of claim 1, wherein the frame further has a nut for facilitating rotation thereof.

6. The manually operated impact tool of claim 1, wherein the one or more elastic elements are attached between the frame and the one of the anvil and impact mass to bias the one of the anvil and impact mass towards the other of the anvil and impact mass.

7. The manually operated impact tool of claim 6, wherein the one or more elastic elements comprise two pairs of springs, each pair being disposed symmetrically around the one of the anvil and impact mass.

8. The manually operated impact tool of claim 1, wherein the output member is an output shaft connected to the one of the anvil and impact mass.

9. The manually operated impact tool of claim 8, wherein the output shaft has a male socket at an end thereof.

10. The manually operated impact tool of claim 1, further comprising:

an engagement member disposed on one of the anvil and impact mass for engaging the other of the anvil and impact mass and maintaining the anvil and impact mass in a predetermined position relative to each other; and a release member disposed on one of the other of the anvil and impact mass and the input member for releasing the engagement and causing the conversion of the potential energy to kinetic energy.

11. A manually operated impact tool comprising:

an impact member having a pair of impact masses;

an anvil member having a pair of anvil members, the anvil member being rotatably disposed relative to the impact member such that each of the impact masses corresponds to each of the anvils;

an input member operatively connected to one of the impact member and anvil member for imparting a relative rotation between the impact member and the anvil member;

an output member connected to the other of the impact member and anvil member for transferring an impact to a fastener; and one or more elastic elements for storing potential energy upon the relative rotation between the impact member and the anvil member;

wherein conversion of the potential energy to kinetic energy causes each of the impact masses to impact a corresponding anvil and transfer of the impact to the output member and the input member comprises a frame rotatably disposed relative to one of the anvil member and impact member, the frame having a portion which interferes with one of the anvil member and impact member such that rotation of the frame causes a rotation of the one of the anvil member and impact member relative to the other of the anvil member and impact member.

12. The manually operated impact tool of claim 11, wherein each of the pair of impact masses extend in opposite directions from the impact member.

13. The manually operated impact tool of claim 11, wherein the anvil member and impact member rotate relative to each other about a central portion.

14. The manually operated impact tool of claim 13, wherein each of the anvil member and impact member further have a reduced thickness portion at the central portion such that when assembled together, an overall thickness of the assembled anvil member and impact member is less than the combined thickness of the impact member and anvil member outside of the central portion.

15. The manually operated impact tool of claim 11, wherein the frame further has a nut for facilitating rotation thereof.

16. The manually operated impact tool of claim 11, wherein the one or more elastic elements are attached between the frame and the one of the anvil member and impact member to bias the one of the anvil member and impact member towards the other of the anvil member and impact member.

17. The manually operated impact tool of claim 16, wherein the one or more elastic elements comprise two pairs of springs, each pair being disposed symmetrically around the one of the anvil member and impact member.

18. The manually operated impact tool of claim 11, wherein the output member is an output shaft connected to the one of the anvil member and impact member.

19. The manually operated impact tool of claim 18, wherein the output shaft has a male socket at an end thereof.

20. The manually operated impact tool of claim 11, further comprising:

an engagement member disposed on one of the anvil member and impact member for engaging the other of the anvil member and impact member and maintaining the anvil member and impact member in a predetermined position relative to each other; and a release member disposed on one of the other of the anvil member and impact member and the input member for releasing the engagement and causing the conversion of the potential energy to kinetic energy.

* * * * *